US008113963B2

(12) United States Patent
Amron

(10) Patent No.: US 8,113,963 B2
(45) Date of Patent: Feb. 14, 2012

(54) WATER BASED ENTERTAINMENT DEVICE

(75) Inventor: Alan Amron, Brooklyn, NY (US)

(73) Assignee: Thought Development Inc, Boca Raton, FL (US)

( * ) Notice: Subject to any disclaimer, the term of this patent is extended or adjusted under 35 U.S.C. 154(b) by 334 days.

(21) Appl. No.: 12/234,452

(22) Filed: Sep. 19, 2008

(65) Prior Publication Data

US 2010/0016092 A1 Jan. 21, 2010

Related U.S. Application Data

(60) Provisional application No. 61/086,681, filed on Aug. 6, 2008, provisional application No. 61/082,427, filed on Jul. 21, 2008.

(51) Int. Cl.
*A63H 23/10* (2006.01)
*A63H 23/00* (2006.01)

(52) U.S. Cl. ..... 472/128; 446/153; 239/203

(58) Field of Classification Search ..... 472/117, 472/128, 136, 137; 446/153–159; 239/203, 239/204

See application file for complete search history.

(56) References Cited

U.S. PATENT DOCUMENTS 2,434,767 A * 1/1948 Hertel ..... 239/204
2,796,293 A * 6/1957 Becker ..... 239/204
2,935,266 A * 5/1960 Coleondro et al. ..... 239/456
7,762,901 B1 * 7/2010 Atkinson et al. ..... 472/128

* cited by examiner

*Primary Examiner* — Kien Nguyen
(74) *Attorney, Agent, or Firm* — Brian K. Dinicola

(57) ABSTRACT

A water based entertainment device in accordance with an embodiment of the present application is connected to a garden hose to provide smooth walls of water that define an enclosed dry that is substantially free of water spray.

14 Claims, 21 Drawing Sheets

FIG.7A
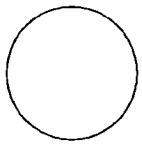
FIG.7B
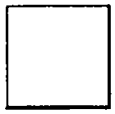
FIG.7C
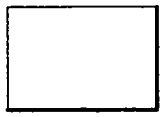
FIG.7D
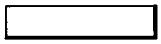
FIG.7E
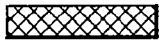
FIG.7F
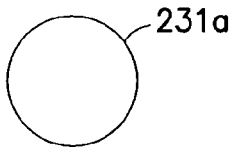
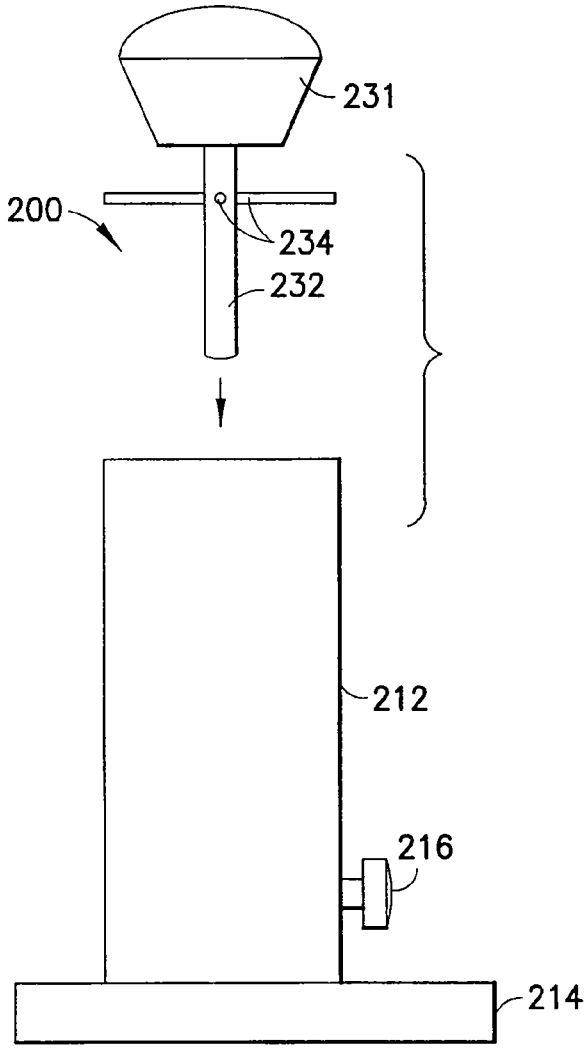
FIG.7

WATER BASED ENTERTAINMENT DEVICE

CROSS-REFERENCE TO RELATED APPLICATIONS

The present application claims benefit of and priority to U.S. Provisional Patent Application Ser. No. 61/082,427 filed Jul. 21, 2008 entitled WATER BASED ENTERTAINMENT SYSTEM and to U.S. Provisional Patent Application Ser. No. 61/086,681 filed Aug. 6, 2008 entitled WATER BASED ENTERTAINMENT DEVICE, the entire contents of each of which are hereby incorporated by reference herein.

BACKGROUND

1. Field of the Disclosure

The present application relates to a water based entertainment device. In particular, the present application relates to a device that is utilized to provide a three dimensional (3D) enclosure with walls made of water in which an individual may remain without being exposed to water spray.

2. Related Art

Sprinklers have long been the source of summer fun for children, particularly those who do not have access to pools. However, since most sprinklers are designed for the utilitarian purpose of irrigation, they are typically not intended for entertainment purposes.

SUMMARY

It is an object of the present disclosure to provide a water based entertainment device.

A water based entertainment device in accordance with an embodiment of the present application includes a connector operable for connection to a hose, a tube in fluid communication with the connector such that water from the garden hose flows in the tube and a diffusion head positioned on a top end of the tube such that an opening is provided between a bottom surface of the diffusion head and the top end of the tube when water is flowing in the tube to provide a substantially smooth wall of water flowing out from the diffusion head to define an enclosure.

A water based entertainment device in accordance with an embodiment of the present application includes an arch, a connector operable for connection to a hose positioned at a bottom of the arch, a connection hose connected to the connector and a diffusion head mounted on a top of the arch and connected to the connection hose such that water from the hose is provided to the diffusion head, the diffusion head operable to provide a smooth wall of water on at least one side of the arch.

A portable water based entertainment device in accordance with an embodiment of the present application includes a connector operable for connection to a hose, a tube in fluid communication with the connector such that water from the hose flows in the tube and a flange positioned at the top of the tube and operable to deflect water flowing out the top of the tube to provide a substantially smooth wall of water defining an enclosure.

A portable water based entertainment device in accordance with an embodiment of the present application includes a connector operable for connection to a hose, a tube in fluid communication with the connector such that water from the hose flows in the tube, wherein a top of the tube is flared outward such that water flowing out the top of the tube provides a substantially smooth wall of water defining an enclosure.

A portable water based entertainment device in accordance with an embodiment of the present application includes a base structured to provide a stable platform, a tube extending from the base, a pump mounted in the base operable to pump water from an adjacent water source into the tube and a diffusion head positioned on a top end of the tube such that an opening is provided between a bottom surface of the diffusion head and the top end of the tube when water is flowing in the tube to provide a substantially smooth wall of water flowing out from the diffusion head to define an enclosure.

A water based entertainment device in accordance with another embodiment of the present application includes a base with a substantially flat bottom to provide a stable platform, a hollow portion formed in a top surface of the base, a tube mounted in the hollow portion and extending upward therefrom, an inlet formed in the bottom surface of the hollow portion, a pump mounted in the base between the inlet and the tube and operable to pump fluid from the hollow portion of the base via the inlet and into the tube and a diffusion head position on a top end of the tube such that an opening is provided between a bottom surface of the diffusion head and the top end of the tube when water is flowing in the tube to provide a substantially smooth wall of fluid flowing out from the diffusion head to define an enclosure.

Other features and advantages of the present invention will become apparent from the following description of the invention which refers to the accompanying drawings.

BRIEF DESCRIPTION OF THE DRAWING(S)

FIG. 7 illustrates a water based entertainment device in accordance with another embodiment of the present application.

FIGS. 7A-7F illustrate diffusion heads of different shapes for use in the water based entertainment device of FIG. 7.

Figure 13:
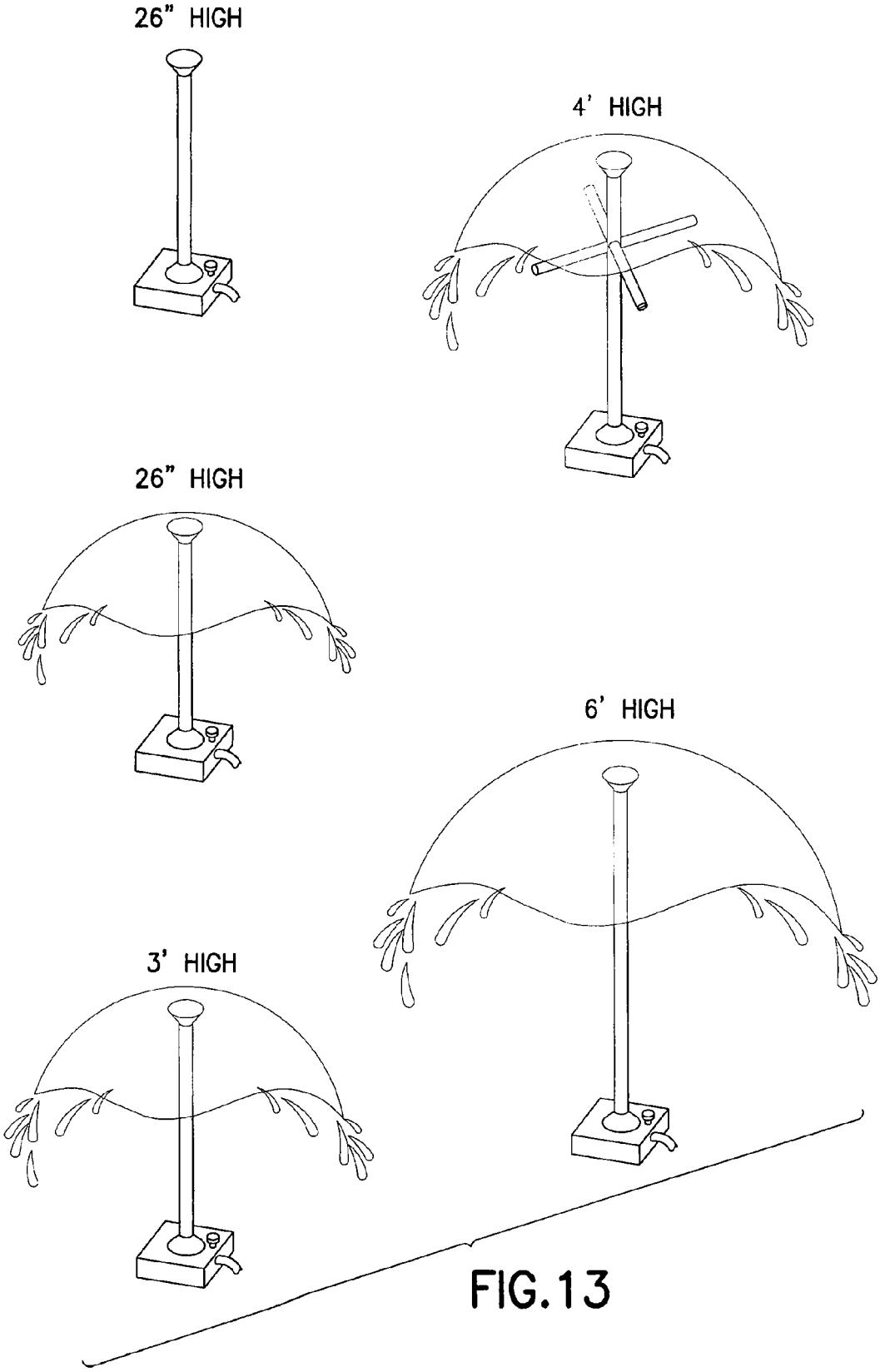

FIG. 13 includes photographs of water based entertainment devices in accordance with the present application including vertical tubes of different heights.

Figure 14:
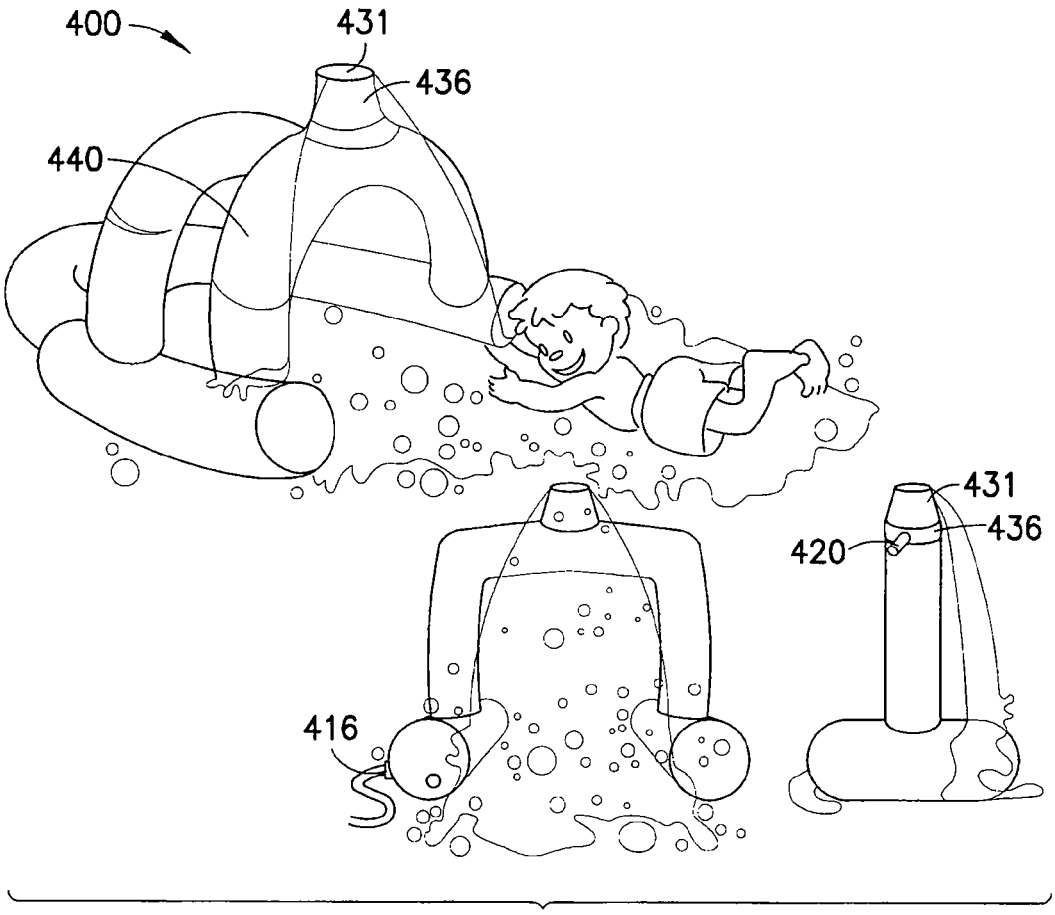

FIG. 14 is an illustration of an alternative embodiment of a water based entertainment device in accordance with an embodiment of the present application.

Figure 15:
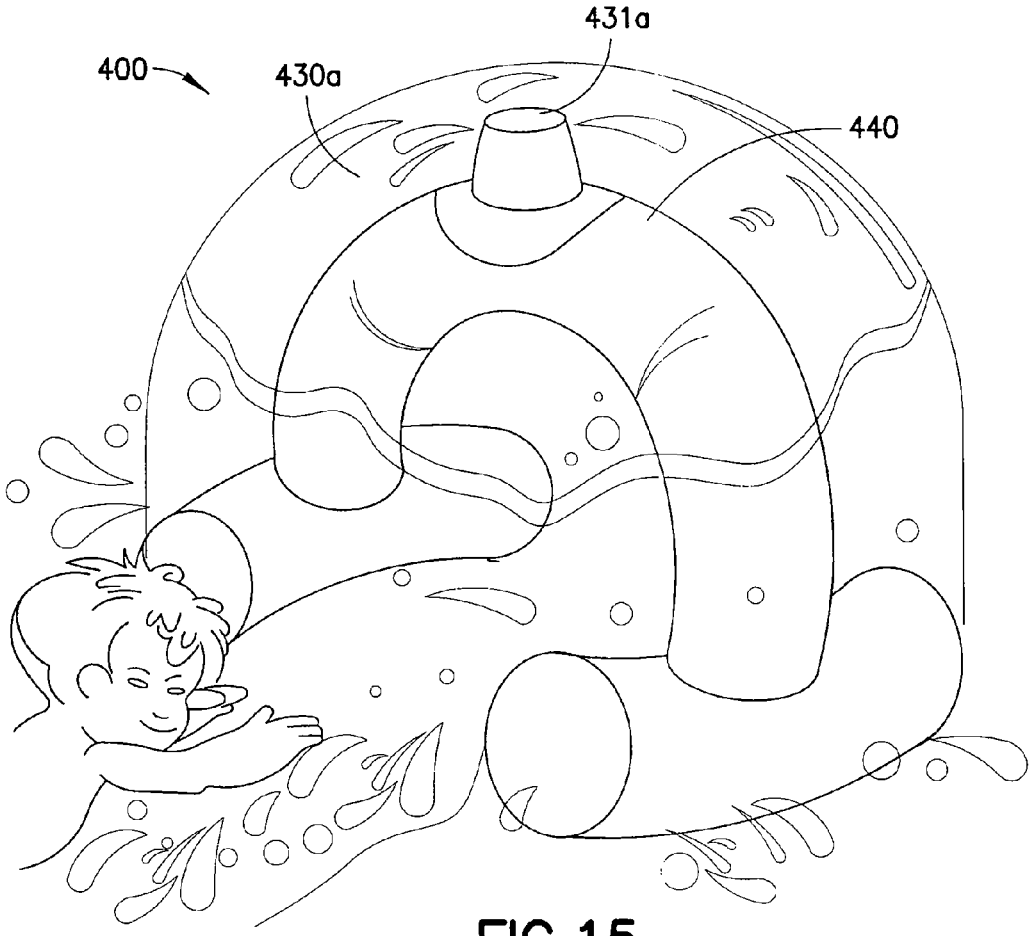

FIG. 15 illustrates an embodiment of the device of claim 14 utilizing a different diffusion head.

Figure 16:
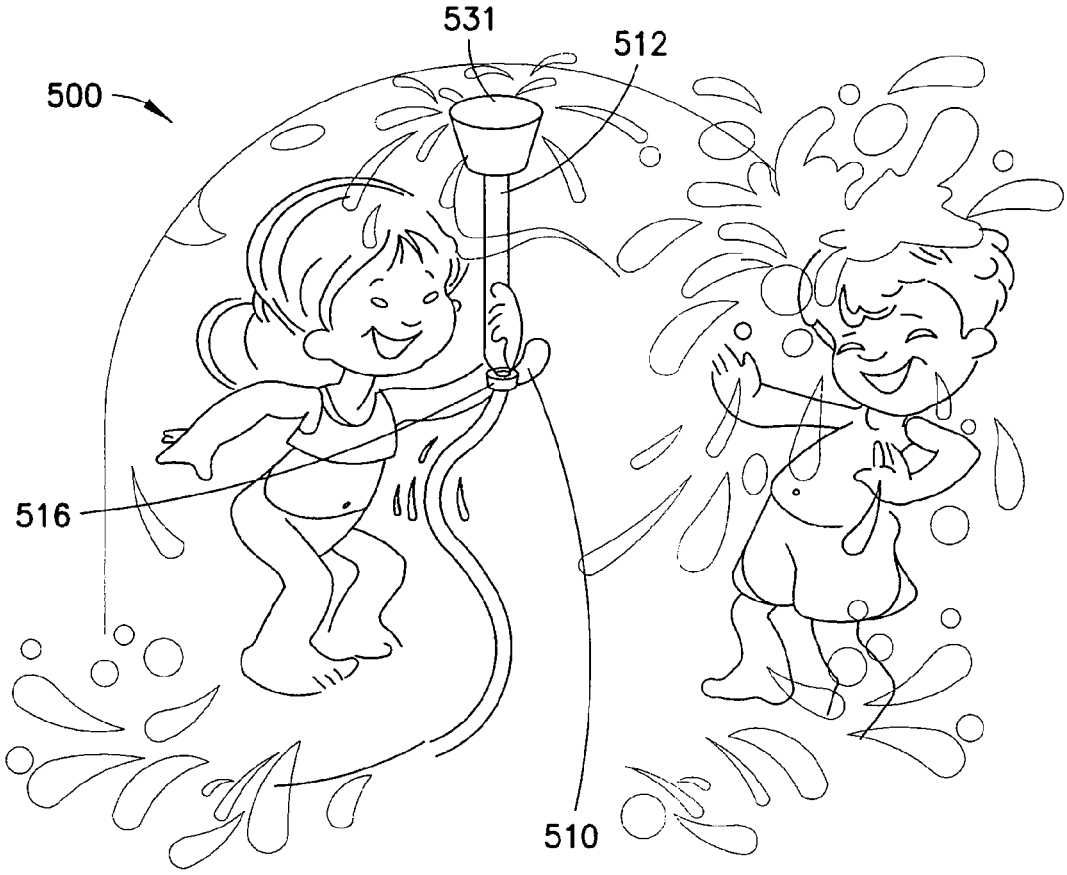

FIG. 16 is an embodiment of a water based entertainment device in accordance with another embodiment of the present application.

Figure 17:
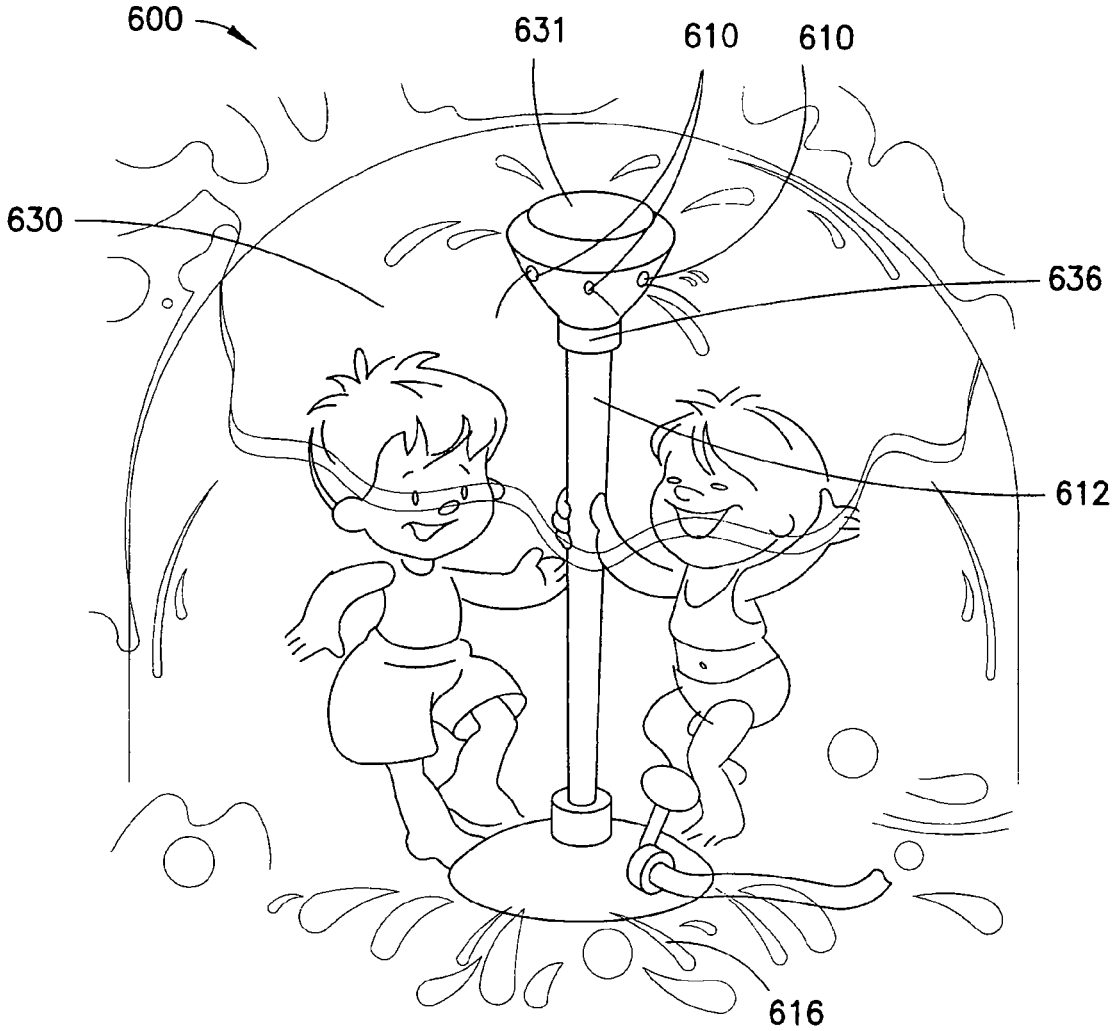

FIG. 17 is an embodiment of a water based entertainment device in accordance with an embodiment of the present application.

Figure 17A:
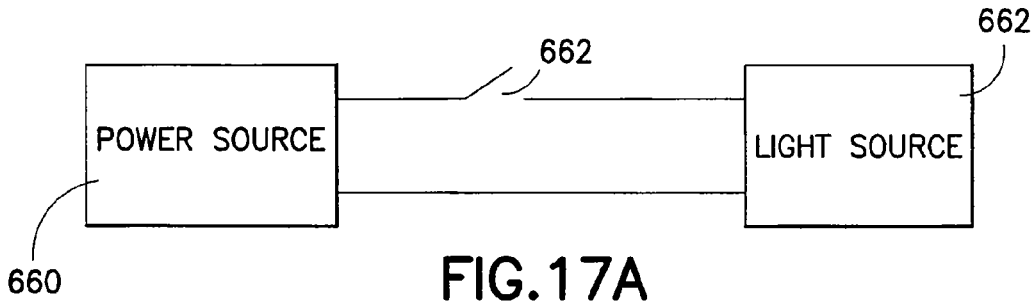

FIG. 17A is an exemplary block diagram of a power source switch and light source for use in the water based entertainment device of FIG. 17.

Figure 17B:
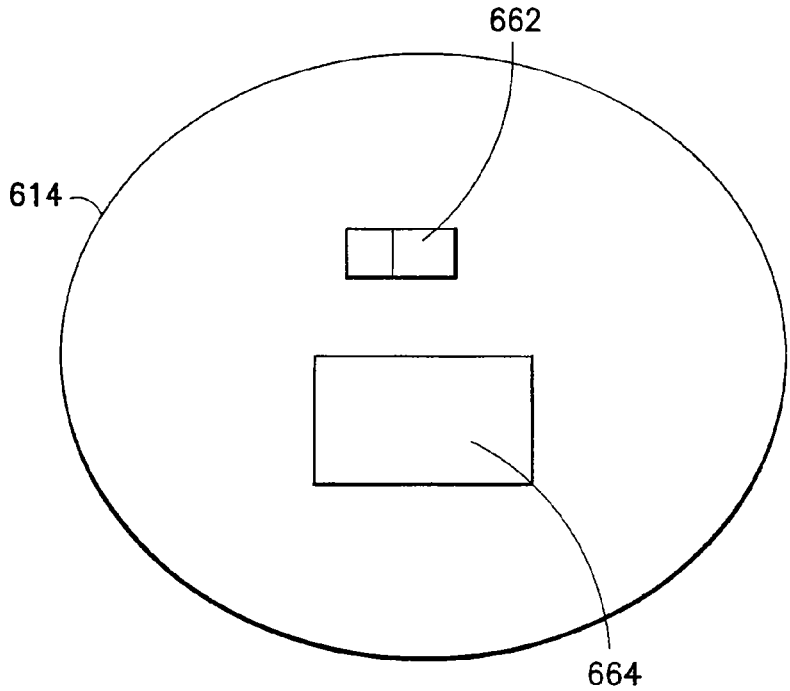

FIG. 17B is an illustration of a bottom surface of a base of the water based entertainment device of FIG. 17 in accordance with an embodiment of the present application.

Figure 17C:
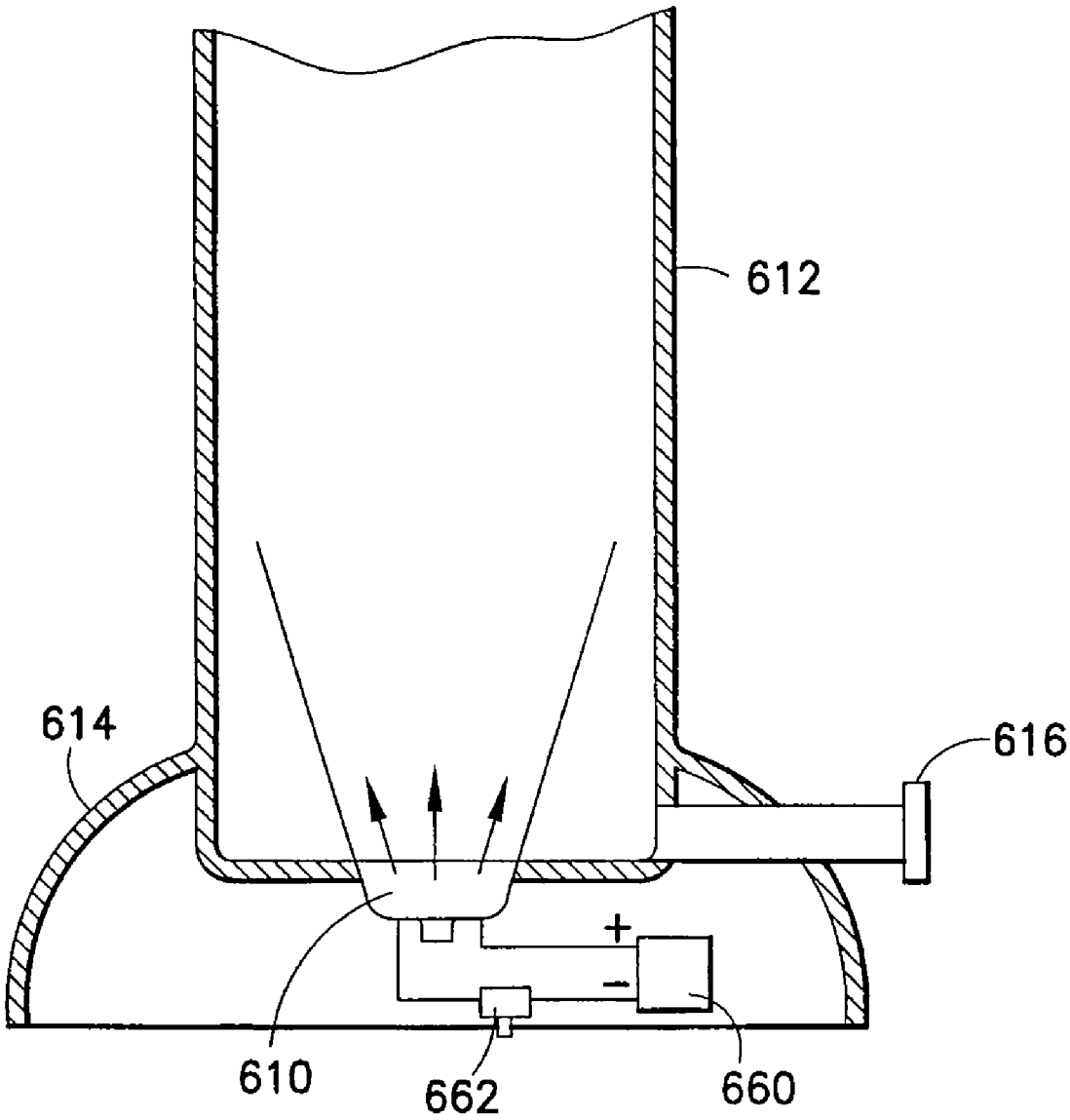

FIG. 17C is an illustration a water based entertainment device in accordance with another embodiment of the present application.

Figure 18:
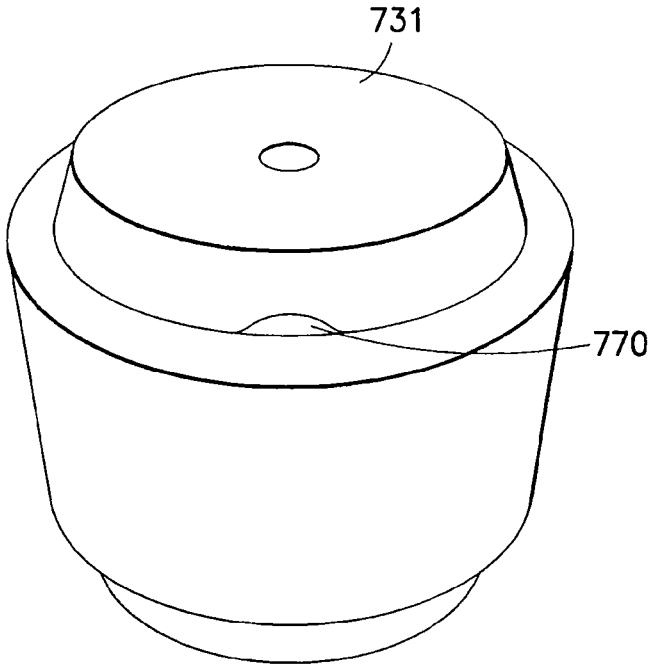

FIG. 18 is an illustration of an alternative embodiment of a diffusion head suitable for use with the water based entertainment device of the present application.

Figure 19:
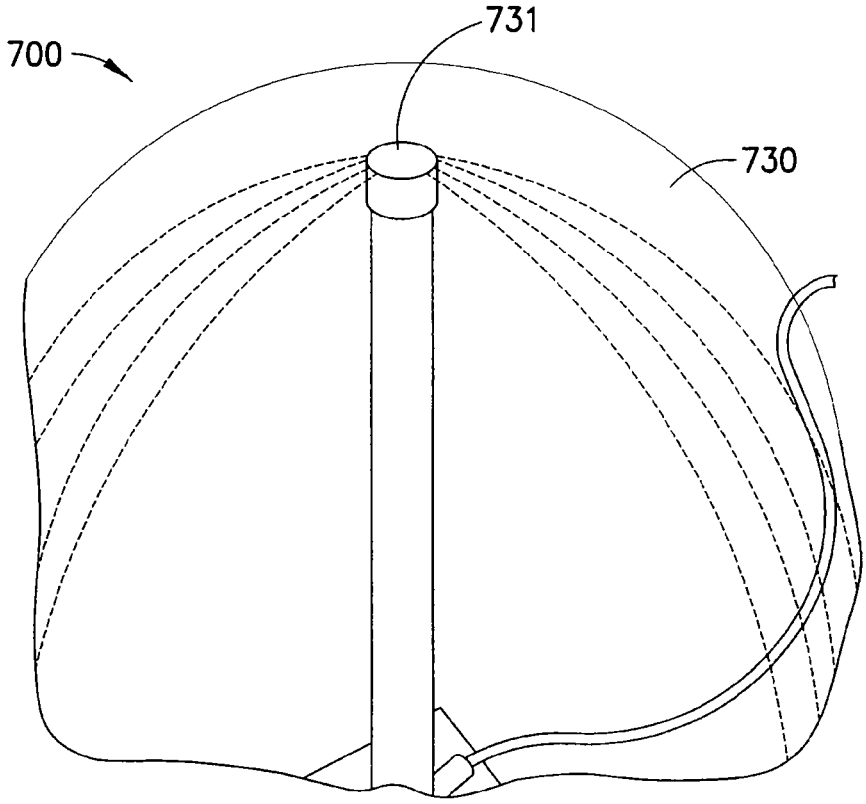

FIG. 19 is an illustration of a water based entertainment device of the present application utilizing the diffusion head of FIG. 18.

Figure 20:
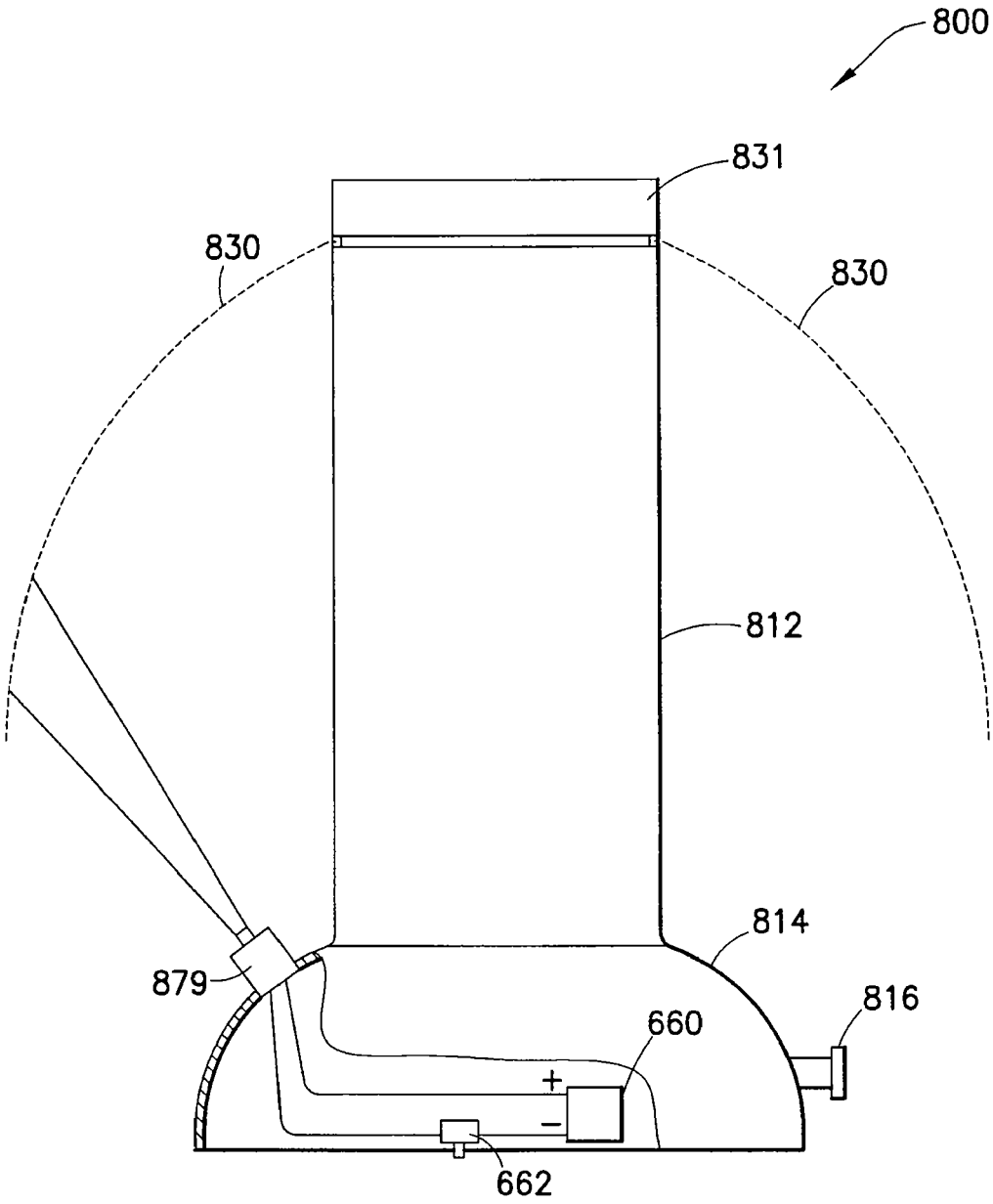

FIG. 20 is an illustration of a water based entertainment device in accordance with another embodiment of the present application.

Figure 21:
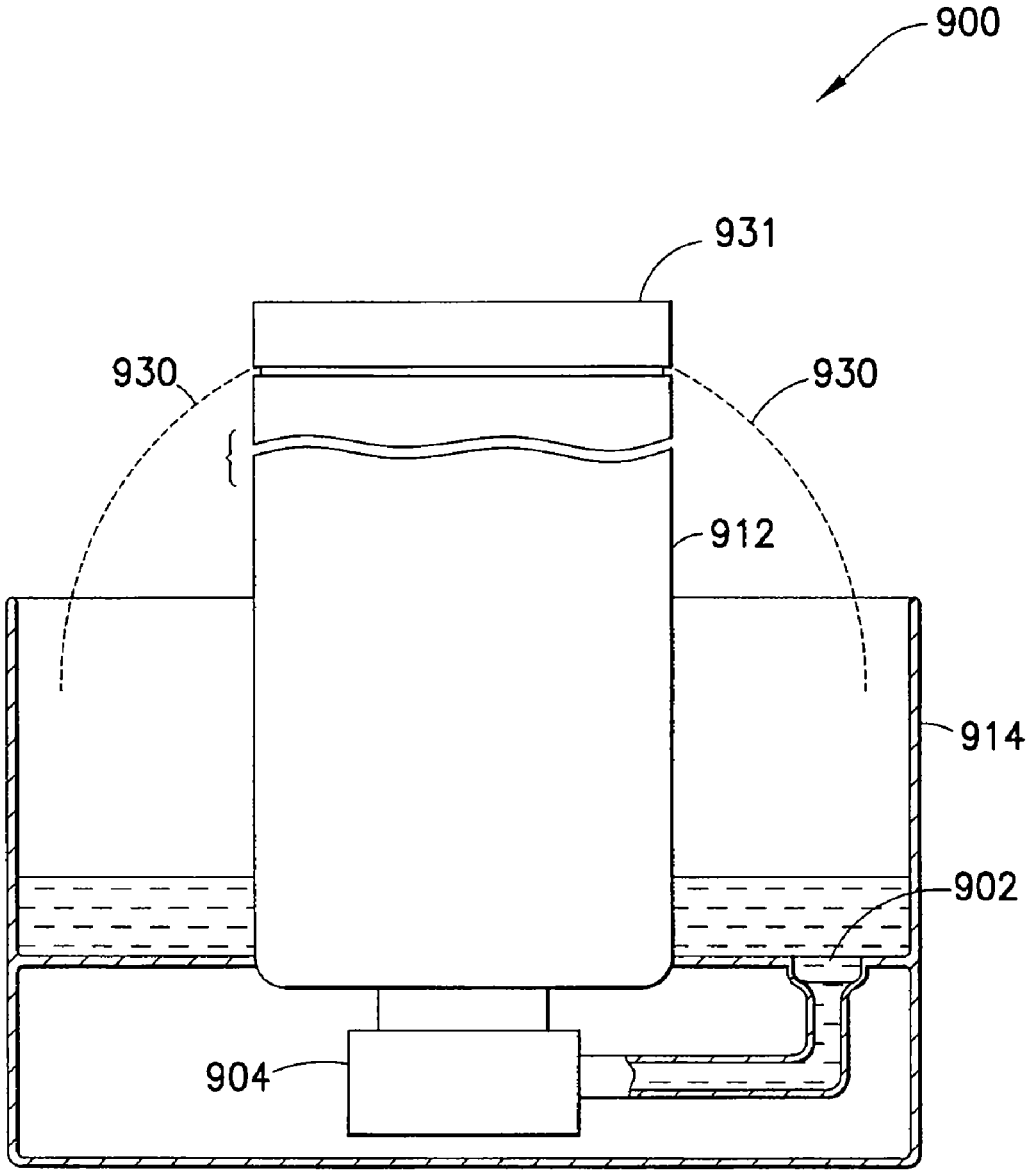

FIG. 21 is an illustration of a water based entertainment device in accordance with another embodiment of the present application.

DETAILED DESCRIPTION OF THE EMBODIMENTS

Figure 1:
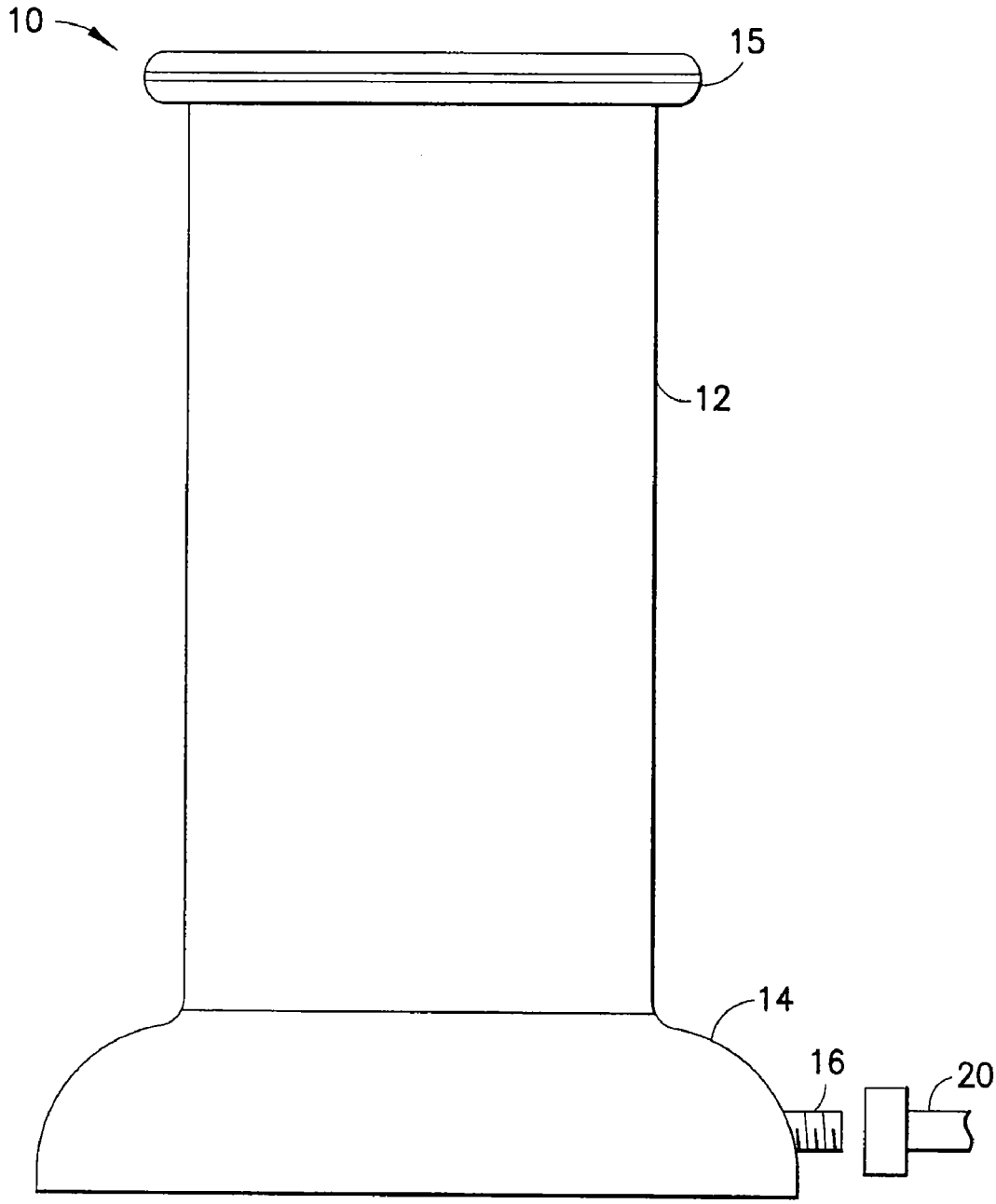
FIG. 1 is a front perspective view of a water based entertainment device in accordance with an embodiment of the present application.

FIG. 1 illustrates a water based entertainment device 10 in accordance with an embodiment of the present application. As can be seen in FIG. 1, the device 10 preferably includes a tube 12 which is connected to a base 14 such that it preferably extends upward from the base. The base 14 includes a connector 16 that is suitable for connection to a hose 20 to provide water to the device 10.

Figure 2:
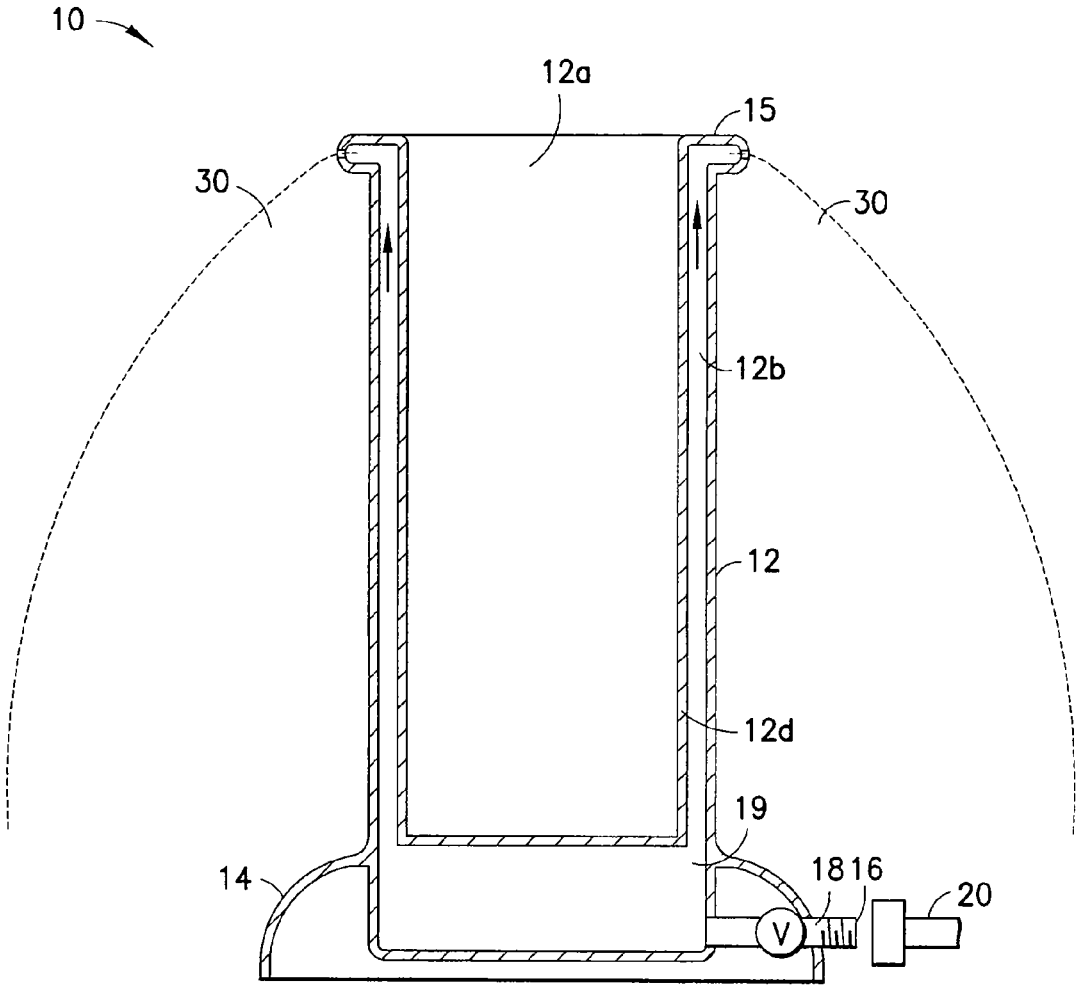
FIG. 2 is a cross sectional view of the device of FIG. 1.

As can be seen in the cross sectional view of the device 10 illustrated in FIG. 2, the tube 12 may include a hollow central portion 12*a* and a water channel 12*b* extending around the outer portion of the tube 12. The inner wall 12*d* forms the inner surface of the water channel 12*b* and the outer surface of the hollow central portion 12*a*. The hose 20 is connected to the connector 16 to provide water to the device 10. A regulator 18 may be provided in the path of the water in order to regulate the pressure of the water in the device 10 to a desired level. Thereafter, the water flows into the reservoir area 19 and up through the water channel 12*b* as indicated by the arrows until it reaches the flange 15 positioned at the open end of the water channel. The flange 15 deflects the water outward (see dotted lines in FIG. 2). The resulting sheath of water surrounding the tube 12 defines a substantially enclosed dry area, or enclosure, 30 around the device 10 that is substantially free of water spray. That is, the sheath of water forms substantially smooth walls of water that enclose a defined area. This enclosure is considered "dry" because it is largely free of water spray. In a preferred embodiment, this enclosed area is large enough for a user to stand or sit in without interfering with the wall of water. The wall of water is substantially smooth in that at least a substantial portion of the wall is continuous and does not include voids or spaces. In this particular embodiment, the enclosure has a cocoon or umbrella like shape. That is, the device 10 provides a sort of water cocoon into which a user may step, and avoid water spray if desired. Naturally, users may move into and out of this cocoon area, as well, to enjoy the cooling effects of the water. The flange 15 may have a tapered shape similar to that of the top portion of the tube 112 discussed below and illustrated in FIG. 4, for example, if desired.

While the tube 12 is illustrated as being substantially cylindrical in shape, it need not be limited to this shape. It is noted that the shape of the tube 12 and the flange 15 may be changed in order to change the shape of the enclosed dry area 30. The tube 12 may be of any desired height such that the device 10 may be used by children and adults alike. The hose 20 is preferably a typical garden hose, but need not be limited thereto. The regulator 18 is typically used to reduce the pressure of the water provided by the hose 20 since typical garden hose pressure is usually too high to produce a smooth shaped dry area 30, however, under certain conditions it may be necessary to boost water pressure as well. Further, as is described below, the regulator 18 may be eliminated altogether in certain embodiments.

Figure 3:
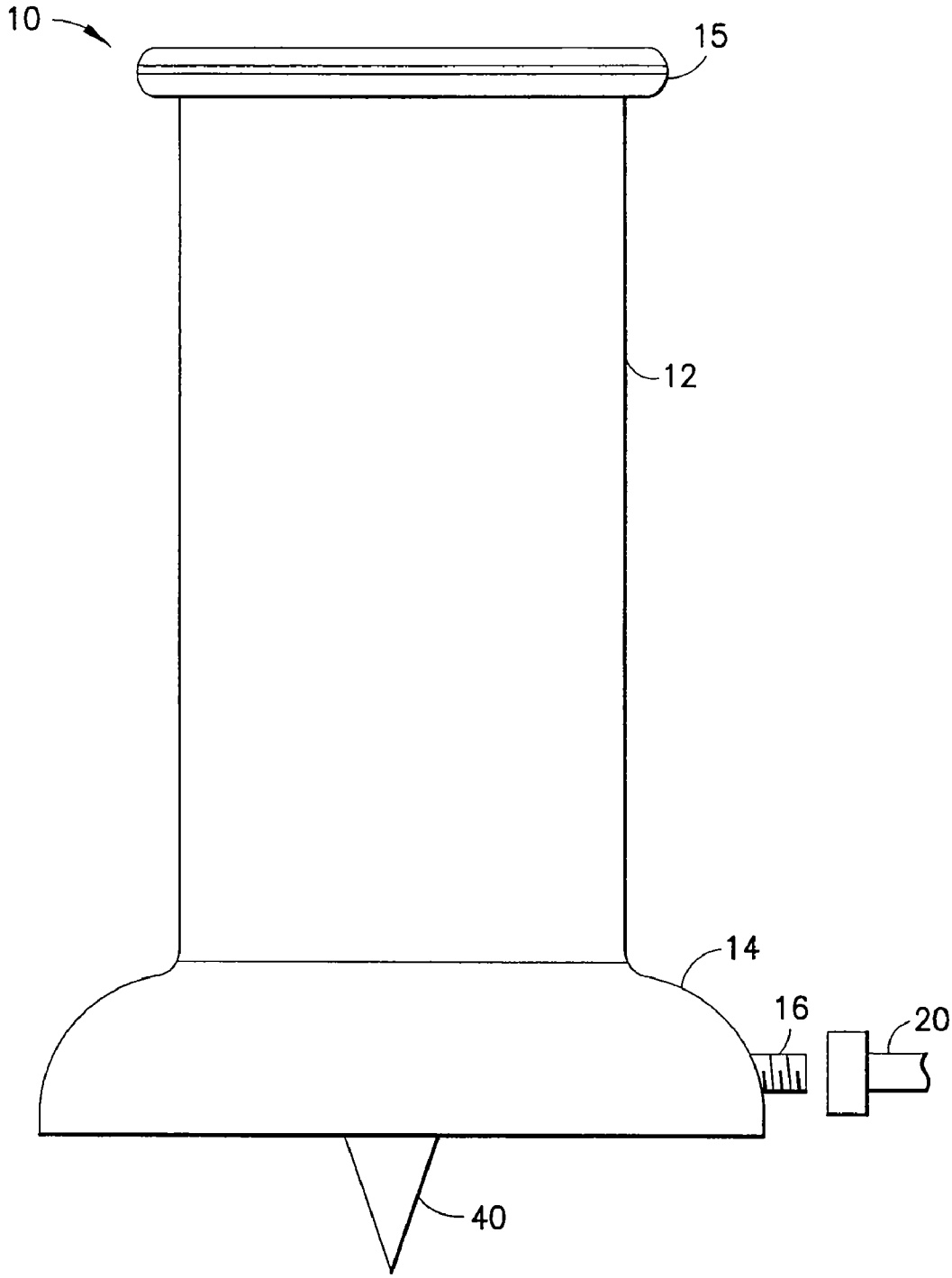
FIG. 3 is a front perspective view of a water based entertainment device in accordance with another embodiment of the present application.

The base 14 preferably has a substantially flat bottom surface as illustrated in FIGS. 1 and 2 such that the device can be positioned on the ground easily. In an alternative embodiment, a spike 40 may be removably connected to the bottom surface as illustrated in FIG. 3. The spike 40 allows the device 10 to be positioned on an uneven surface such a lawn, for example. Otherwise, the device of FIG. 3 is identical to that of FIGS. 1 and 2. Indeed, in a preferred embodiment, the device of FIGS. 1 and 2 includes an opening to removably mount the spike 40 therein when desired.

Figure 4:
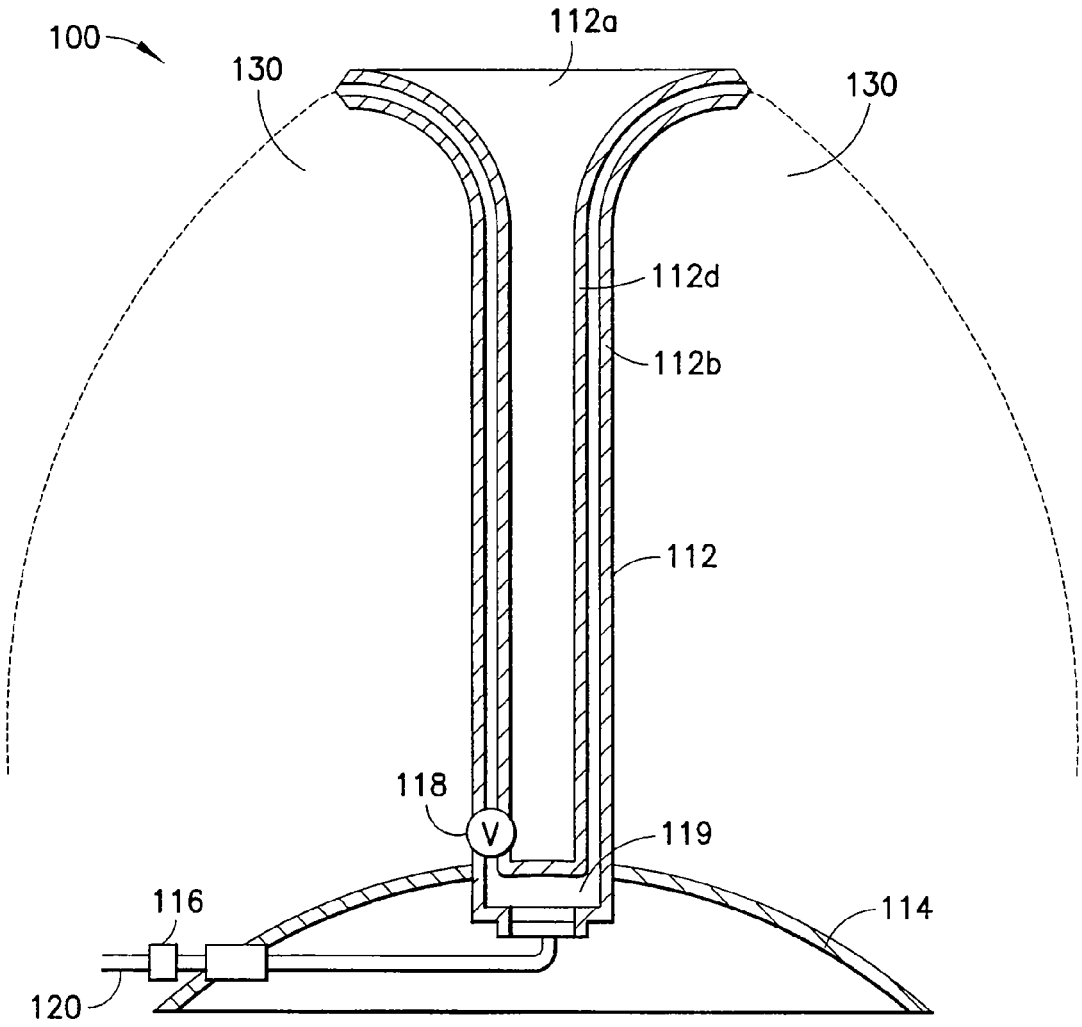
FIG. 4 is a cross sectional view of a water based entertainment device in accordance with another embodiment of the present application.

An alternative embodiment of a water based entertainment device 100 is illustrated in FIG. 4. In this embodiment, the tube 112 has a substantially cylindrical shape on a bottom portion thereof but is flared at the top portion thereof. In this embodiment, the inner wall 112*d* serves to deflect the water flow outward to provide the dry area 130, and thus the flange of FIGS. 1-3 is unnecessary. The diameter of the flared top portion may be adjusted to provide for a larger or smaller dry area 130 as desired. That is, a larger diameter will generally provide for a larger dry area 30. Further, the regulator 118 may be positioned between the reservoir area 119 and the channels 112*b* to regulate the pressure of water flowing into the channels to ensure a smooth sheath of water is provided to define the dry area 30. The connector 116 is similar to the connector 16 of FIG. 1 and is preferably connected to the hose 120. Further, the base 114 is similar to the base 14 of FIG. 1.

In both embodiments, the size of the opening at the top of the water channels 12*b*, 112*b* may be varied in order to provide the continuous sheath of water that defines the dry areas 30, 130. In a preferred embodiment, the opening is relatively narrow, or thin, to encourage the sheet-like appearance of the sheath of water that defines dry areas 30, 130. Further, the angle at which the water exits these openings may be adjusted to adjust the size of the dry areas 30, 130. The regulators 18, 118 provide a desired pressure for the water provided to the water channels 12*b*, 112*b*. Thus, the regulators ensure that the sheath that defines the dry areas 30, 130 is generally continuous. However, as noted below, the regulators are not necessary. The base 114 of the device 100 of FIGS. 4-6 may also include a spike similar to spike 40 illustrated in FIG. 3, if desired. The height of the tube 12, 112 is preferably set such that the enclosed dry area 30, 130 is suitable for use by children, as illustrated in FIGS. 5-6, for example, however, any height may be used.

Figure 5:
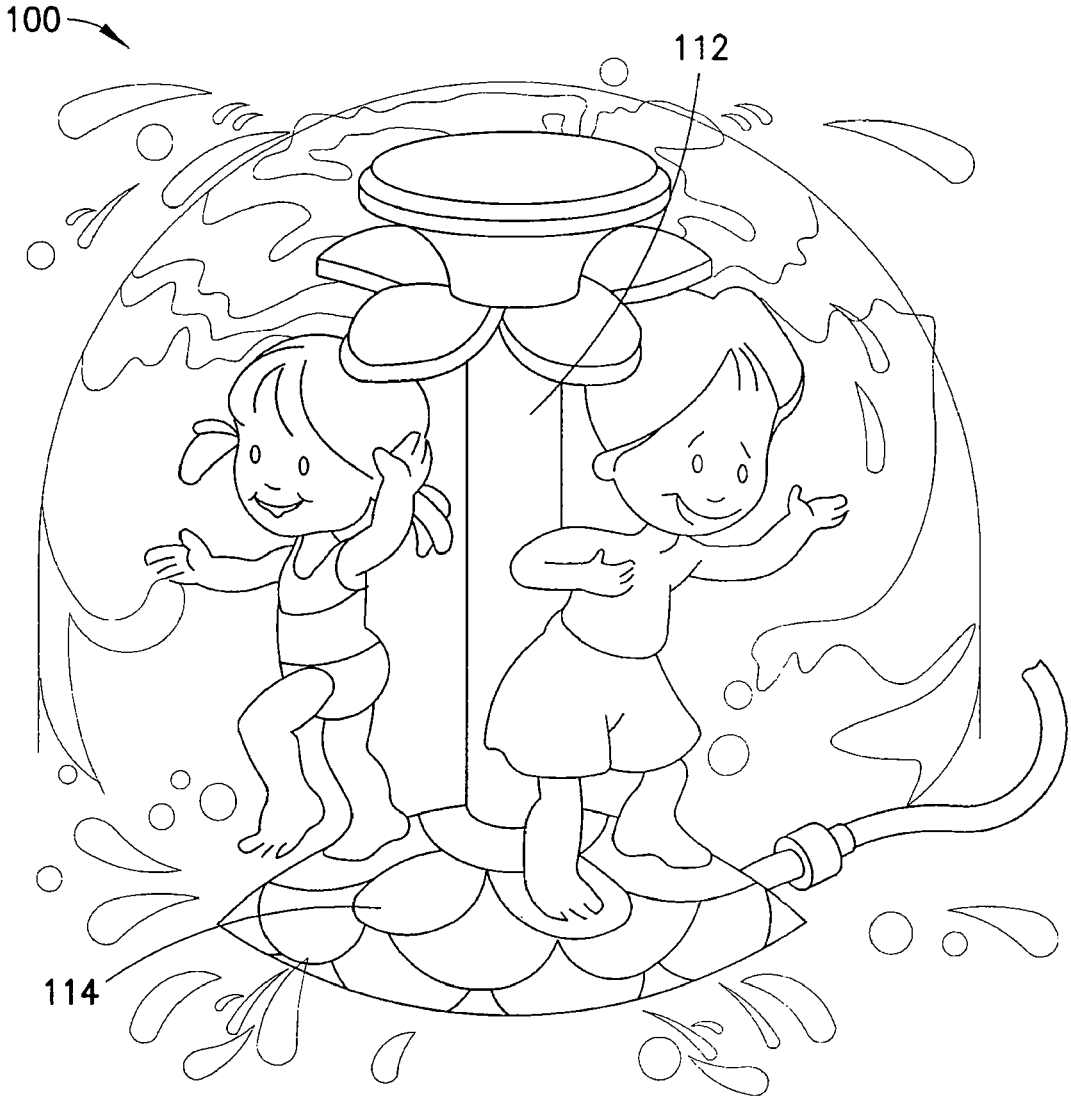
FIG. 5 is a perspective view of the device of FIG. 4.
Figure 6:
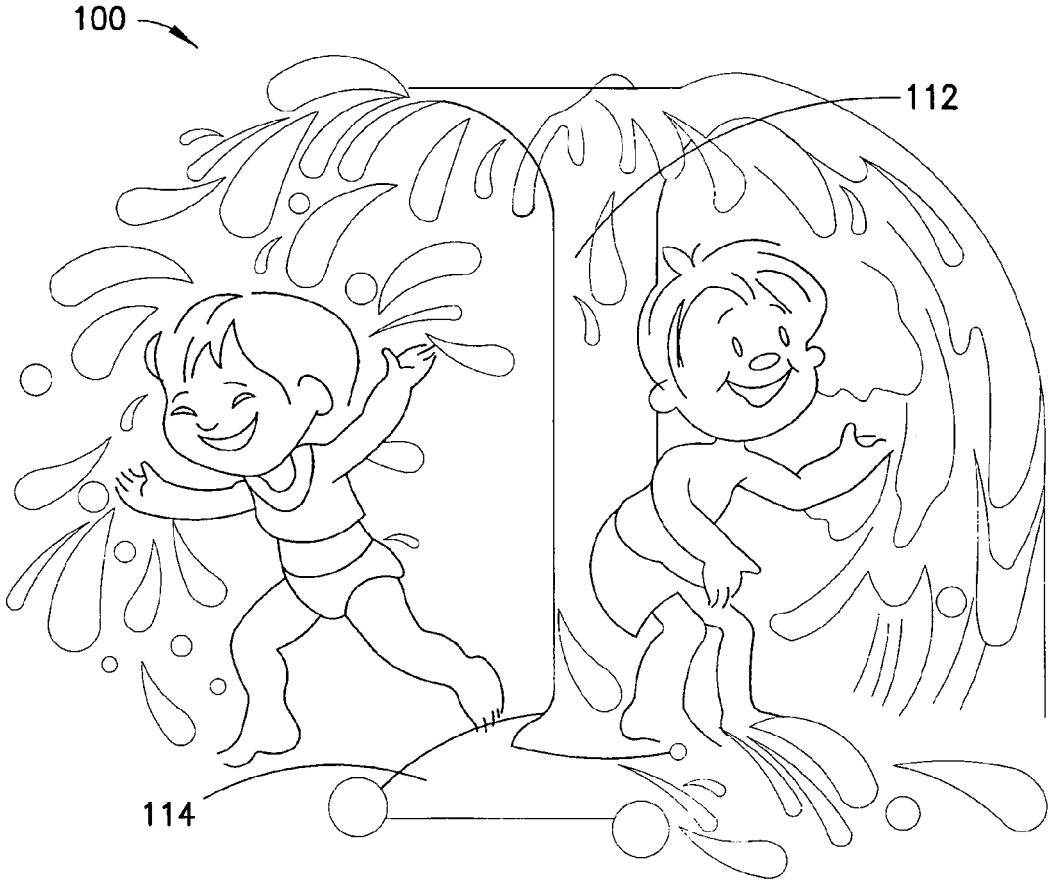
FIG. 6 is another perspective view of the device of FIG. 4.

FIG. 5 is an illustration of children playing in the dry area of an entertainment device similar to that illustrated in FIG. 4. FIG. 6 is similar to FIG. 5 except that one of the children is passing through the wall of water. FIG. 7 illustrates another embodiment of a water based entertainment device 200 in accordance with an embodiment of the present application. In this embodiment, hollow tube 212 extends from the base 214, which is connected to a hose via the connector 216 in a manner similar to that discussed above. A diffusion head 231 is mounted at the top end of a stabilizing stem 232, which is inserted into the top end of the tube 212. A plurality of stabilizing elements 234 are preferably provided to stabilize the head 231 relative to the tube 212.

Figure 8:
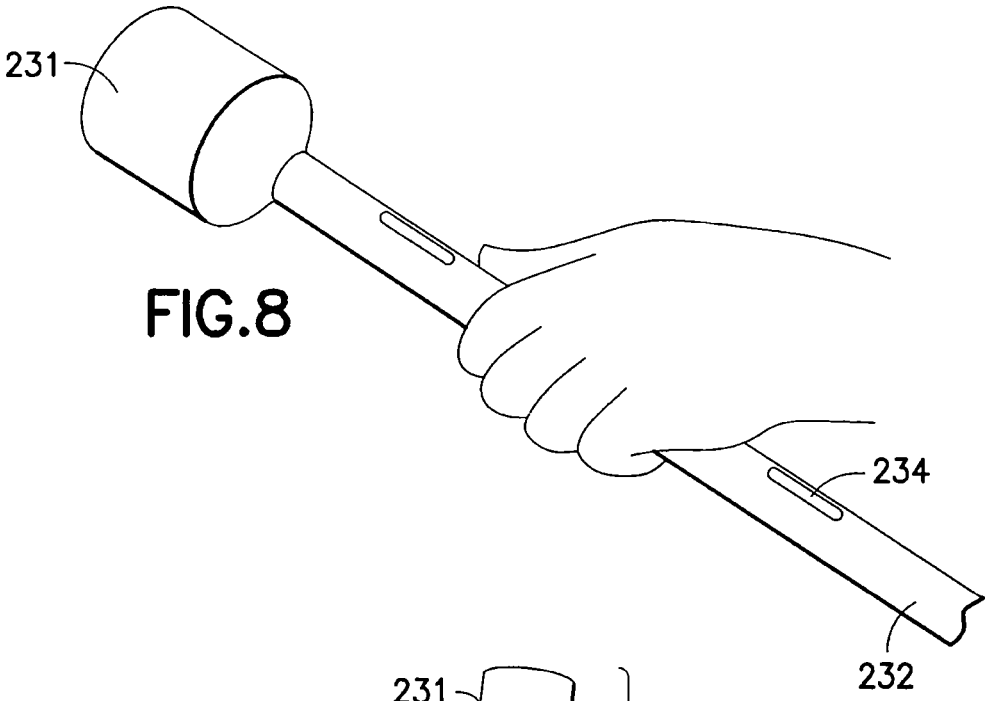
FIG. 8 is a photograph of a diffusion head and stabilizing stem of the water based entertainment device of FIG. 7.

While FIG. 7 illustrates the use of pins as the stabilizing elements 234, they may be any shape. For example, the photograph of FIG. 8 illustrates the insertion of fin-shaped stabilizing elements 234 in the stem 232. The stabilizing elements 234 may be of any shape provided that they minimize flow interruption of water through the tube 212 and keep the head 231 stable relative to the tube 212. That is, they minimize lateral movement of the stem 232 and the diffusion head 231 relative to the tube 212. The bottom surface of the head 231 is preferably tapered, as illustrated, such that that it has a diameter less than that of the tube 212 at its narrowest point and fits therein. The stem 232 is positioned in the tube 212 such that water will flow through the tube and out between a top of the tube 212 and the bottom surface of the head 231. The pressure of the exiting water will be increased based on the weight of the head 231 bearing down on the top of the tube 212. That is, the weight of the head 231 will restrict the size of the opening that the water will exit through, and thus, increase the output pressure thereof. Adjusting the output pressure allows for adjustment of the size of the dry area, or enclosure, 230. The diffusion head 231 may have a set weight, or may have a weight that can be adjusted, for example by filling it with water in order to set or adjust the size of the dry area 230. A hollow portion may be provided in the top of the diffusion head 231 to accommodate water, or any other material that may be used to adjust the weight of the head.

Figure 9:
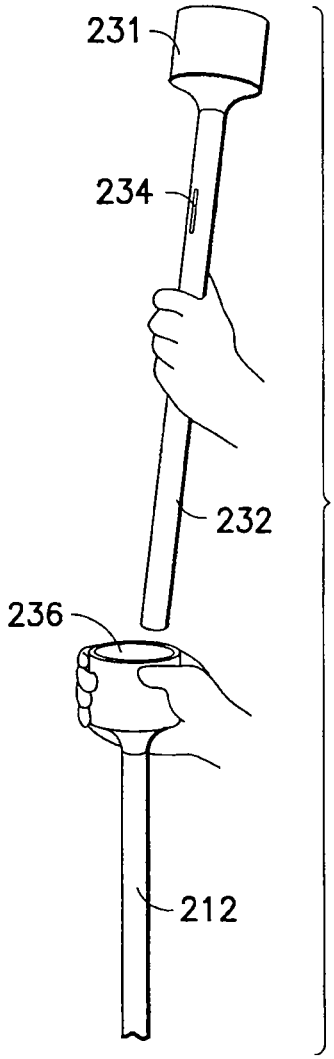
FIG. 9 is a photograph illustrating the relationship between the diffusion head and stabilizing stem of FIG. 8 and a stabilizing collar of the water based entertainment device of FIGS. 7-8.

In a preferred embodiment, a stabilizing collar 236 is provided at the top of the tube 212 as illustrated in the photograph of FIG. 9. The head 231 then interacts with the collar 236 rather than directly with the top of the tube 212 itself. The collar 236 also helps to stabilize the head 231 relative the tube 212.

While FIG. 7 illustrates a generally round diffusion head 231, also shown in FIG. 7A, a variety of shapes may be used. For example, as illustrated in FIG. 7B, a square shape may be used. Alternatively as illustrated in FIG. 7C, a rectangular shape may be used. In addition, as illustrate din FIG. 7D, the head 231 may be shaped to provide a smooth wall, or curtain of water. Similarly, the head 231 may be shaped and textured to provide a rougher wall of water as illustrated in FIG. 7E.

Figure 10:
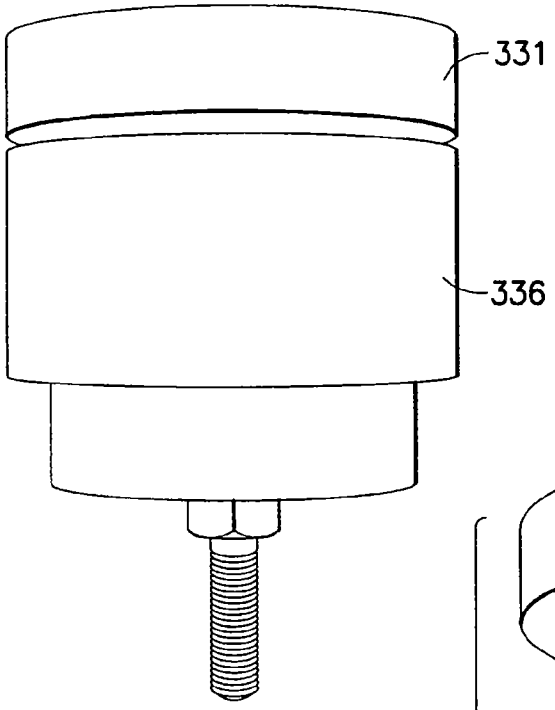
FIG. 10 is a photograph of an alternative embodiment of a diffusion head of the water based entertainment device of the present application.
Figure 10A:
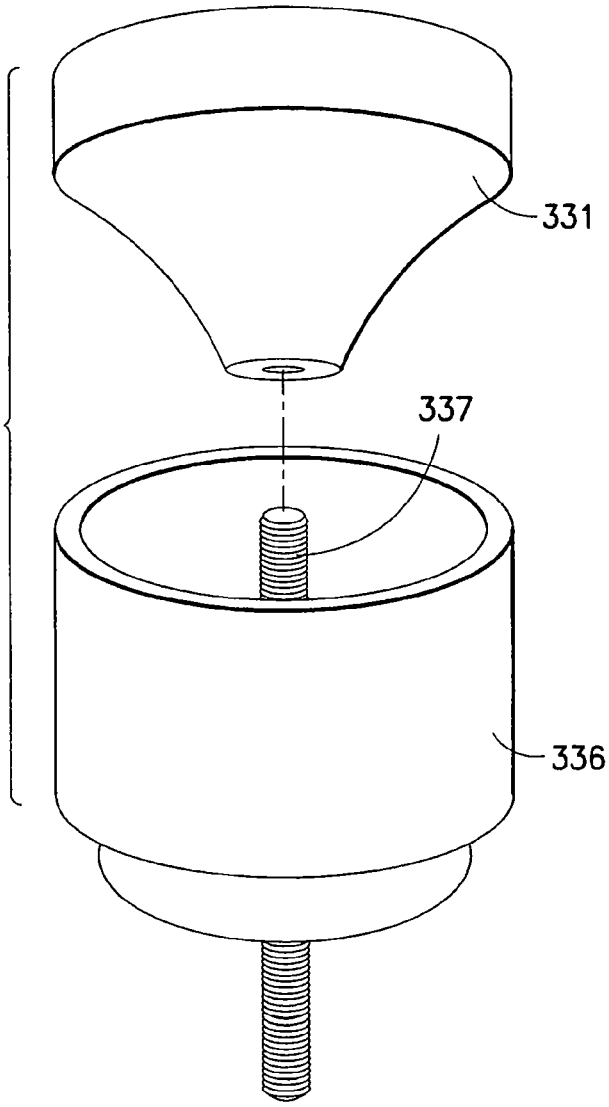
FIG. 10A is a photograph of the alternative diffusion head of FIG. 10 with the head separated from the collar.
Figure 11:
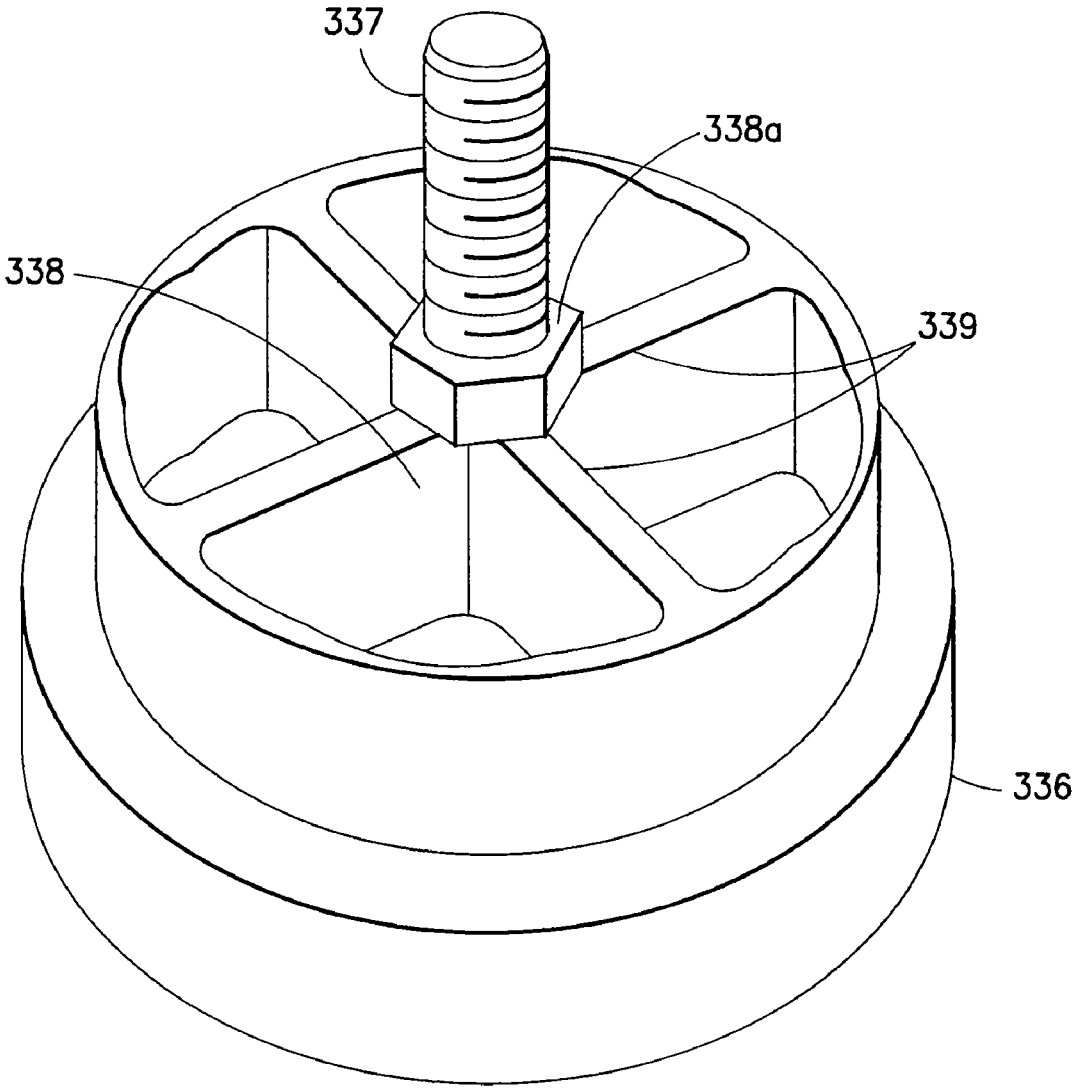
FIG. 11 is a photograph of a bottom view of the alternative diffusion head of FIG. 10.

In another embodiment, the diffusion head 231 and stem 232 may be replaced by the screw down diffusion head 331 of FIG. 10. Preferably the head 331 is threadedly engaged in the collar 336, which is attached to the top of the tube 212, for example, such that the spacing between the bottom surface of the head 331 and the top surface of the collar 336 can be adjusted. FIG. 10A illustrates the head 331 separated from the collar 336. In this manner, the pressure of the water exiting through this opening can be adjusted to control the size of the dry area 330 (see FIG. 12A-12D for example) in a simple manner. As can be seen in FIG. 11, the threaded bolt 337 passes though a bore 338 formed in a center section 338*a* of the collar 336. The center section 338*a* is supported by the intersecting walls 339, which allow water to flow through the openings 339*a* therebetween. The threaded bolt 337 may also be used to secure the collar portion 336 to the tube 212, for example. In this case a similar center section and bore is provided in the top part of the tube 212. While FIG. 10 illustrates a circular head 331, as can be seen in FIGS. 12A-D, the head 331 may have any one of several different shapes including but not limited to a square, a star, an oval and a lotus-type shape. The head 330 may also be shaped to provide a curtain of water as illustrated in FIG. 12E.

While particular embodiments of the diffusion head are illustrated and described herein, other embodiments are possible provided that the shape allows water to escaped between the bottom surface of the diffusion head and the top of the tube 212, for example, to provide the smooth walls of water discussed herein. For example, the diffusion head may simply be a sphere with a maximum diameter that is slightly larger than the diameter of the tube 212 so that a portion of the sphere will fit in the top of the tube. FIG. 7F illustrates an exemplary embodiment of a spherical diffusion head 231*a*. The spherical head 231*a* may be mounted on a stem similar to stem 232 or simply positioned at the top of the tube without the stem. The spherical head 231*a* may be weighted to maintain an opening of a desired size between its bottom surface and the top of tube. Alternatively, the spherical head 231*a* may include a recess or hollow portion where material can be added to adjust weight to adjust the opening size. Otherwise the device works in substantially the same manner as described above with reference to FIG. 7.

Figure 12A:
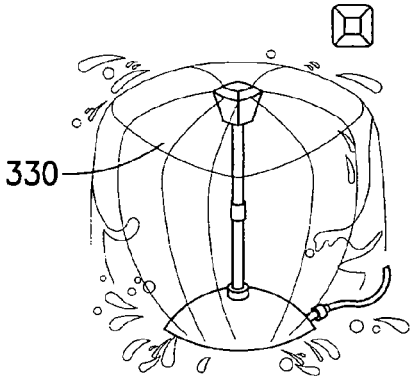
FIGS. 12A-12F illustrate various embodiments of a water based entertainment device in accordance with the present application using diffusion heads of different shapes.
Figure 12D:
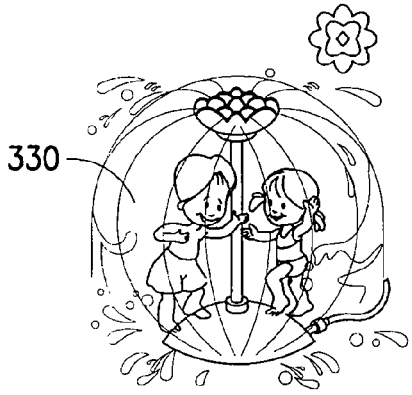
Figure 12B:
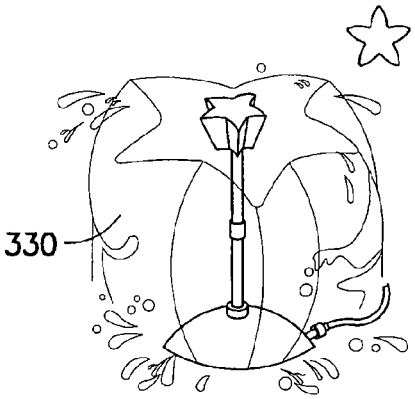
Figure 12F:
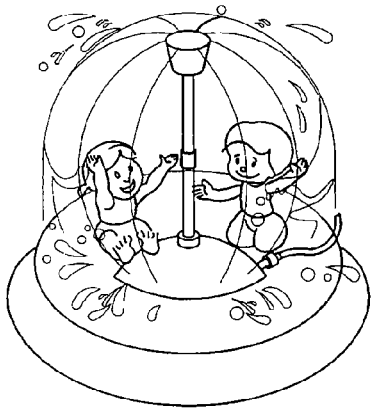
Figure 12C:
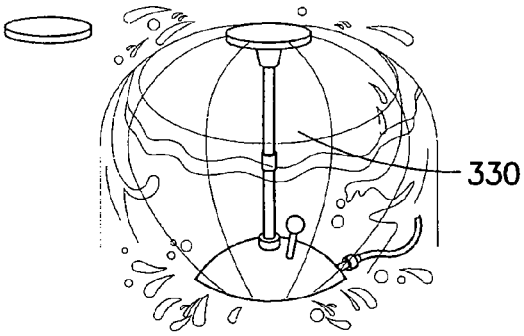
Figure 12E:
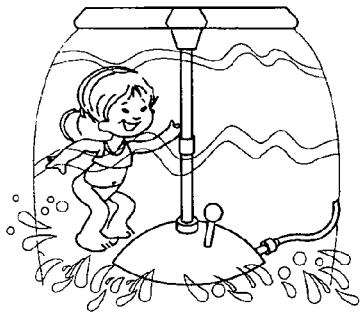

In another embodiment, illustrated in FIG. 12F, for example, a pump may be provided in the base 14, 114, 214 and placed in a pool, or other water source, for example. The pump is used to draw water into the device 10, 100, 200 without the need for a garden hose. In this manner, the same water can be reused over and over, and thus, water can be conserved. The pump is preferably battery operated and safe for use in a submerged environment. Otherwise operation of the device in FIG. 12F is similar to that described above. This makes the device portable since there is no need to be near a hose in order to use it.

In another embodiment illustrated in FIG. 14, the device 400 may be mounted on an arch 440 such that a curtain of water falls from the top of the arch. While FIG. 14 illustrates the arch 440 as an arcuate element, it is noted that the arch need not be limited to this specific embodiment. Any suitable structure that raises the diffusion head 431 up such that a user can pass directly underneath it may be used. As is mentioned above, the device 200 for example may include a diffusion head that provides for a curtain for water. Users can crawl or slide through the arch 440, and thus the curtain of water. This embodiment would be useful in combination with a Slip 'N Slide® (a registered trademark of Wham-O Inc.) water slide, for example, to allow a user to slide under the arch 440 and the curtain of water falling therefrom. In this embodiment, a connector 416 for connection to the garden hose, or other suitable water source is preferably located at a bottom of the arch and a connection piece 412 is used to provide a connection between the connector 416 and the diffusion head 431 at the top of the arch 440. That is, the connection piece 412 takes the place of the tube described above. This connection piece 412 is in fluid communication with the connector 416 and a lower collar 436 similar to the stabilizing collar 236 discussed above, on which the diffusion head 431 is mounted. In this case, there is no need for the stem on the diffusion head since there is no tube to mount it in. Alternatively, the head 431 may be screwed to the collar 436 in a manner similar to that described above with reference to FIG. 10.

Alternatively, a more typical diffusion head 431*a* may be used to provide an enclosed dry area, or enclosure, 430 similar to the areas 30, 130, 230, 330 described above where the dry area 430 surrounds the arch 440. This is illustrated in FIG. 15, for example.

In another embodiment, the water based entertainment device 500 may be hand held, as illustrated in FIG. 16. In this embodiment, a handle 510 is preferably formed at the bottom of the tube 512 to aid a user in holding the device 500. The connector 516 is connected to a garden hose, or other suitable water supply and water flows up the tube 512 and out the diffusion head 531 in a manner similar to that described above. The diffusion head 531 may be mounted on the tube 512 in any of the ways described above.

In another alternative embodiment, the water based entertainment device 600 may include a light source 610, for example, a light emitting diode LED's. If desired, multiple light sources 610 may be provided. The light source, or sources, 610 are preferably mounted in the base 614 of the device 600. Specifically, the light source 610 is preferably mounted adjacent to the flow path of water entering the base via connector 616 and flowing toward the tube 612. In a preferred embodiment the light source 610 projects light upward through the tube 612, and the water flowing therethrough, such that the water exiting the tube is luminescent. A water proof lens may be provided between the light source and the water. This embodiment is illustrated in FIG. 17C, for example, which illustrates a lower portion of the device 600. A power source 660 to power the light source 610 and a switch 662 are also preferably positioned in the base 614. The power source 660 is preferably a battery, or batteries, that provide suitable power to the light source 610. FIG. 17A illustrates an exemplary block diagram illustrating the relative connections of the power source 660, switch 662 and light source 610. The switch 662 is preferably accessible from the bottom surface of the base 614 which helps to isolate it from water and also helps prevent accidental activation. However, the switch 662 may be positioned elsewhere, if desired. In addition, access to the power source 660 may be provided from the bottom surface of the base, as well, via access door 664, for example, as illustrated in FIG. 17B. In this manner, all of the electrical elements can be isolated in the base 614 and protected from exposure to water. Alternatively, the light source 610, may be mounted in the diffusion head 631 to. The light source 610 may be mounted on the bottom surface of the diffusion head 631 adjacent to the opening that is formed between the diffusion head and the tube 612, or collar 636. An example of such a device 600 is illustrated in FIG. 17. The inclusion of the light source 610 is particularly useful for use at night. The light source 610 may be incorporated into or used in conjunction with any of the diffusion heads described herein. Regardless of which embodiment is used, The light source 610, power source 660 and switch 662 should be made safe for use in an environment where they are likely to get wet. In another embodiment, the water based entertainment device 700 may be used to provide a wall of water that forms the partially enclosed dry area 730, but includes an opening in the wall of water that allows users to enter the dry area without getting wet at all. See FIG. 19, for example. In this embodiment, the diffusion head 731 includes a notch 770 as illustrated in FIG. 18. As a result, the smooth wall of water does not completely surrounding the device 700 as can be seen in FIG. 19. The notch 770 serves to divert water such that an opening in the water wall is formed.

In another embodiment, illustrated in FIG. 20, a projector 879 may be provided to project a movie or other video image on the smooth walls of water that define the dry area, or enclosure 830 to further enhance the entertainment value of the device 800. In one embodiment, the projector 879 is mounted in the base 814 and projects images on an inner surface of the wall of water. In an alternative embodiment, the projector may be mounted in the base in a manner similar to the light source 610 described above and project inverted images into the tube and the water therein such that they are visible when the water exits the tube and forms the wall of water. The projector 879 could be powered via the power source 660 described above, or may be provided with a separate power source 860. A power switch 862 is also preferably provided to turn the projector on and off. The device 800 is otherwise similar to the device 200 described above.

In another alternative embodiment, the device 900 may be reduced in size such that it is suitable for positioning on a table top, for example. Naturally, in this embodiment, the dry area 930 will not be large enough for a user to enter it. The base 914 forms a reservoir of water that is used with the device. The reservoir area is preferably formed by a hollow portion formed on the top of the base 914 as illustrated in FIG. 21, for example. An inlet opening 902 is provided in a bottom surface of the hollow portion and is connected to a pump 904 mounted in the base 914 such that the pump pumps water out of the reservoir area. The tube 912 is connected to the output of the pump 904 such that the water sucked into the inlet 902 is pumped up into the tube 912. A diffusion head 931 is provided at the top of the tube. The diffusion head 931 is similar to the diffusion heads described above, for example, diffusion head 231 and provides for smooth walls of water that define the dry space 930 in a manner similar to that described above. In addition, if desired, the tube 912 may include an ornament, for example, for decorative or entertainment purposes. The pump 904 may be powered by a battery, or any other suitable power source and may be turned on and off with a switch. In FIG. 21, the power source 660 and switch 662 of FIG. 17C are illustrated, but any suitable power source and switch may be used.

In general, for all embodiments, the tube 12, 112, 212, 312, 512, 612, 712, 812, 912 has a diameter of approximately 2 inches. The maximum diameter of the diffusion head 231, 331, 531, 631, 731 is preferably about 2.5 inches. The tubes are generally cylindrical in shape but may be other shapes if desired. While a garden hose is the preferred water source, any hose, or any other suitable pressurized water source may be used. Naturally, if desired, different sized tubes and heads may be used. In addition, the average pressure of the water exiting the garden hose 20, for example, is about 70 PSI. Generally, the pressure of the water exiting the device is about 7 PSI. However, as is noted above, the output pressure can be adjusted by reducing the exit size, if desired. While internal pressure regulation may be provided, a suggested in the embodiment of FIGS. 1-6, such internal pressure regulation is not necessary. For example, the device 200 of FIG. 7 does not use any internal pressure regulation. The volume of the water in the device provides sufficient output pressure to form the enclosed dry area discussed herein. Further, the spacing between any diffusion head and any tube or collar can be adjusted to adjust this pressure without the need for an internal regulator. The tubes may be of any desired height. For Example, FIG. 13 illustrates photographs of devices that utilize a 26-inch tube, a 3-foot tube, a 4-foot tube and a 6-foot tube. All of these devices happen to use the head 331 mentioned above, but tube height may be varied regardless of which embodiment is used. In addition, an extension tube may be provided and added to the tubes, for example, to provide for height adjustment. Further, it is preferred that a shut off valve be provided between the connector and the hose so that the flow of water to the device van be shut off.

While the entertainment device of the present application is illustrated with reference to specific embodiments, it is noted that there are many ways in which the enclosed dry areas 30, 130, 230, 330, 430, 530, 630, 730, 830, 930 may be provided and the present application is not limited to the embodiments described herein.

While the device of the present application has been described as a water based entertainment device, it is noted that the device would be suitable for use with virtually any fluid. Thus, the term water, as used herein, refers more broadly to any fluid. For example, the smaller device 900 described above with reference to FIG. 21, could be used in conjunction with an alcoholic beverage, for example, as entertainment for a social event.

Although the present invention has been described in relation to particular embodiments thereof, many other variations and modifications and other uses will become apparent to those skilled in the art. It is preferred, therefore, that the present invention be limited not by the specific disclosure.

What is claimed is:

1. A water based entertainment device, comprising:

a connector operable for connection to a hose;

a tube in fluid communication with the connector such that water from the hose flows in the tube; and a diffusion head being secured to prevent vertical movement relative to a top end of the tube before and during water flow and having a bottom surface dimensioned and arranged such that an opening is defined between the bottom surface of the diffusion head and the top end of the tube whereby water flowing in the tube exits the opening to provide a substantially smooth wall of water flowing out from the diffusion head and thereby define an enclosure.

2. The portable water based entertainment device of claim 1, wherein a lower portion of the diffusion head is tapered such that it fits into the top end of the tube.

3. The portable water based entertainment device of claim 2, wherein the enclosure is sized such that a user standing in a three dimensional dry space defined by the enclosure will not interfere with the substantially smooth wall of water.

4. The water based entertainment device of claim 3, wherein a size of the opening between the bottom surface of the diffusion head and the top of the tube is adjustable such that increasing the size of the opening decreases a size of the three dimensional dry space and decreasing the size of the opening increases the size of the three dimensional dry space.

5. The water based entertainment device of claim 1, further comprising a base in which the connector is mounted and from which the tube extends.

6. The water base entertainment device of claim 5 wherein the diffusion head includes a notch formed in a peripheral edge thereof such that an opening is provided in the smooth wall of water.

7. The water based entertainment device of claim 1, further comprising a handle suitable for gripping by a user, wherein the connector is mounted in the handle and the tube extends from the handle.

8. The water based entertainment device of claim 1, further comprising a shut off valve positioned between the connector and the hose and operable to turn off the flow of water from the hose to the connector.

9. The water based entertainment device of claim 1, further comprising a mounting collar positioned on the top of the tube and structured to accommodate the lower portion of the diffusion head such that the opening between the bottom surface of the diffusion head and the top of the tube is formed between the bottom surface of the diffusion head and the mounting collar.

10. The water based entertainment device of claim 1, further comprising a stabilizing stem sized to fit within the top end of the tube, wherein the diffusion head is mounted on top of the stabilizing stem, the stabilizing stem operable to stabilize the diffusion head relative to the tube.

11. The water based entertainment device of claim 10, further comprising stabilizing elements extending radially outward from a lower end of the stabilizing stem to prevent the stabilizing stem from moving laterally within the tube.

12. The water based entertainment device of claim 1, wherein the diffusion head further comprises a threaded bolt extending downward from a center section of the bottom surface of the diffusion head.

13. The water based entertainment device of claim 12, further comprising a mounting collar positioned on the top of the tube, the mounting collar including a central section with a bore formed therein such that the bolt of the diffusion head is accommodated by the bore to secure the diffusion head to the mounting collar.

14. The water based entertainment device of claim 13, wherein the bore is threaded to compliment the threaded bolt such that the size of an opening between the mounting collar and the bottom surface of the diffusion head through which water flows to provide the smooth walls of water is adjusted by screwing the bolt into the bore.

* * * * *